US005188522A

United States Patent [19]

Hara

[11] Patent Number: 5,188,522

[45] Date of Patent: Feb. 23, 1993

[54] VANE PUMP WITH A THROTTLING GROOVE IN THE ROTOR

[75] Inventor: Masahiko Hara, Kanagawa, Japan

[73] Assignee: Atsugi Unisia Corporation, Atsugi, Japan

[21] Appl. No.: 781,399

[22] Filed: Oct. 23, 1991

[30] Foreign Application Priority Data

Oct. 25, 1990 [JP] Japan ..... 2-111073[U]

[51] Int. Cl.[5] ..... F04C 2/00; F04C 2/30; F04C 2/32

[52] U.S. Cl. ..... 418/77; 418/82; 418/212; 418/268

[58] Field of Search ..... 418/77, 78, 81, 82, 418/210, 212, 268

[56] References Cited

U.S. PATENT DOCUMENTS

| | | | |
|---|---|---|---|
| 3,399,826 | 9/1968 | Andriulis | 418/212 |
| 4,507,065 | 3/1985 | Shibuya et al. | 418/82 |
| 4,795,325 | 1/1989 | Kishi et al. | 418/77 |

FOREIGN PATENT DOCUMENTS

| | | | |
|---|---|---|---|
| 670659 | 9/1963 | Canada | 418/81 |
| 2631152 | 1/1978 | Fed. Rep. of Germany | 418/82 |
| 29028 | 9/1957 | Finland | 418/77 |
| 57-28889 | 2/1982 | Japan | 418/212 |
| 62-294788 | 12/1987 | Japan | 418/212 |
| 63-167089 | 7/1988 | Japan . | |

*Primary Examiner*—Richard A. Bertsch
*Assistant Examiner*—Alfred Basichas
*Attorney, Agent, or Firm*—Bachman & LaPointe

[57] ABSTRACT

A vane pump is disclosed, which comprises a body structure defining a space which has mutually opposed surfaces; a cam ring tightly disposed in the space; a rotor having a plurality of radially extending vane mounting grooves and rotatably disposed in the cam ring having both sides thereof slidably contacting with the opposed surfaces of the body structure; and a plurality of vanes slidably disposed in the vane mounting grooves in such a manner that heads of the vanes slidably contact with an inner surface of the cam ring. In the invention, the rotor is formed at at least one side thereof with a throttle groove to which bottom portions of the vane mounting grooves are exposed.

19 Claims, 3 Drawing Sheets

VANE PUMP WITH A THROTTLING GROOVE IN THE ROTOR

BACKGROUND OF THE INVENTION

1. Field of the Invention

The present invention relates in general to hydraulic pumps used in motor vehicles, and more particularly to vane pumps of a type which is used as a hydraulic power source for a power steering device or the like.

2. Description of the Prior Art

In order to clarify the task of the present invention, one conventional vane pump of the above-mentioned type will be described, which is disclosed in Japanese Patent First Provisional Publication No. 63-167089. The vane pump of the publication comprises generally a side plate, a rear cover, a rotor carrying a plurality of projectable vanes, and a cam ring accommodating the rotor and slidably disposed between the side plate and the rear cover.

FIG. 7 of the accompanying drawings is a plan view of the rear cover used in the known vane pump of the publication. The inner surface of the rear cover to which the rotor slidably contacts is designated by reference "a". As shown, the inner surface "a" is formed with two pairs of back pressure grooves "b" and "c" through which a discharged fluid is led into vane mounting grooves of the rotor for radially outwardly biasing each vane to contact against an oval inner surface of the cam ring. The two pairs of the back pressure grooves "b" and "c" are arranged symmetrical with respect to a rotation center of the rotor so as to deal with the suction and discharge states of pump chambers of the pump respectively. Each pump chamber is defined by neighboring two vanes. The back pressure grooves "b" are in communication with a discharge chamber of the pump. A throttle groove "e" is formed on the inner surface "a", which extends between each pair of the back pressure grooves "b" and "c". More specifically, the throttle groove "e" is arranged to communicate the vane mounting grooves.

When a vane travels in a suction zone of the pump, the mounting groove for the vane tends to increase its volume. Under this condition, the discharge fluid pressure is applied to the vane mounting groove through the back pressure grooves "b" for assuring the contact of a head of the vane against the oval inner surface of the cam ring. When, on the other hand, the vane travels in a discharge zone of the pump, the vane mounting groove tends to reduce its volume. Under this condition, a part of the hydraulic fluid in the vane mounting groove is forced to return from the back pressure groove "c" to the other back pressure groove "b" through the throttle groove "e".

Since the shape of each throttle groove "e" has a direct effect on the tracing ability of the vane head against the oval inner surface of the cam ring, the throttle grooves "e" have been machined with a high accuracy.

Also the side plate has back pressure grooves and throttle grooves which are similar in construction to those of the above-mentioned rear cover.

However, due to its inherent construction, the vane pump of the above-mentioned type has the following drawbacks.

That is, usually, the rear cover and the side plate are produced by casting aluminium alloy or the like whose hardness is less than that of the rotor. Thus, the inner surface of the rear cover and that of the side plate tend to be markedly worn away by the rotor. This means that the throttle grooves "e" tend to be deformed in a short period of time, having a bad effect on the performance of the pump. Furthermore, machining the rear cover and the side plate for forming the accurately dimensioned throttle grooves requires the employment of skilled labor and time.

SUMMARY OF THE INVENTION

It is therefore an object of the present invention to provide a vane pump which is free of the above-mentioned drawbacks.

That is, according to the present invention, there is provided a vane pump which can keep its normal performance for a long period and which can be easily produced.

According to a first aspect of the present invention, there is provided a vane pump which comprises means defining a space which has mutually opposed surfaces; a cam ring tightly disposed in the space; a rotor having a plurality of radially extending vane mounting grooves and rotatably disposed in the cam ring having both sides thereof slidably contacting with the opposed surfaces of the body means; a plurality of vanes slidably disposed in the vane mounting grooves in such a manner that heads of the vanes slidably contact with an inner surface of the cam ring, wherein the rotor is formed at at least one side thereof with a throttle groove to which bottom portions of the vane mounting grooves are exposed.

According to a second aspect of the present invention, there is provided a vane pump which comprises a body having a recess; a side plate tightly installed in the recess; a cover secured to the body to cover the recess thereby to define an enclosed space between an outer surface of the side plate and an inner surface of the cover, the cover being formed at the inner surface thereof with inlet and outlet ports and back pressure grooves; a cam ring tightly disposed in the enclosed space; a rotor having a plurality of radially extending vane mounting grooves, the rotor being rotatably disposed in the cam ring having both sides thereof slidably contacting with the outer surface of the side plate and the inner surface of the cover; a rotation shaft passing through the body, side plate and the cover having a middle portion thereof on which the rotor is securedly disposed; and a plurality of vanes slidably disposed in the vane mounting grooves in such a manner that heads of the vanes slidably contact with an inner surface of the cam ring, wherein the rotor is formed at at least one side thereof with a throttle groove to which bottom portions of the vane mounting grooves are exposed.

According to a third aspect of the present invention, there is provided a vane pump which comprises a housing; a rotation shaft passing through the housing; and two pump units mounted in the housing in a manner to coaxially arranged on the rotation shaft, each pump unit including means defining in the housing a space which has mutually opposed surfaces; a cam ring tightly disposed in the space; a rotor securedly mounted on the rotation shaft and having a plurality of radially extending vane mounting grooves, the rotor being rotatably disposed in the cam ring having both sides thereof slidably contacting with the opposed surfaces; a plurality of vanes slidably disposed in the vane mounting grooves in such a manner that heads of the vanes slidably contact with an inner surface of the cam ring, wherein the rotor is formed at at least one side thereof with a throttle groove to which bottom portions of the vane mounting grooves are exposed.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
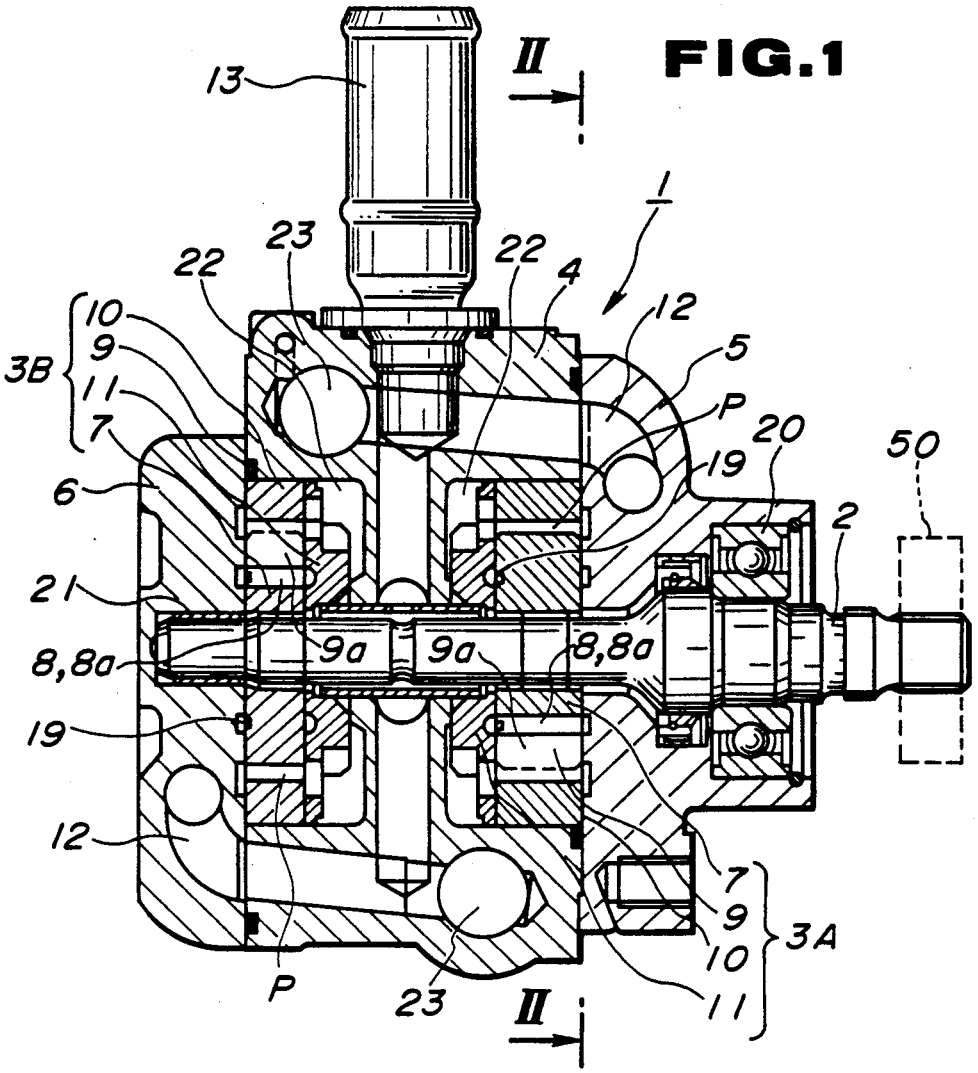
FIG. 1 is a sectional view of a vane pump of a first embodiment of the present invention.

Referring to FIGS. 1 to 4, particularly FIG. 1, there is shown a first embodiment of the present invention, which is a tandem type vane pump 1.

The vane pump 1 comprises a center body 4, a rotation shaft 2 rotatably held in the center body 4, and two tandem pump units 3A and 3B coaxially arranged about the rotation shaft 2. A front cover 5 is mounted on one side of the center body 4 and a rear cover 6 is mounted to the other side of the center body 4. The front cover 5 has a bore (no numeral) through which a front portion of the rotation shaft 2 projects outward, while the rear cover 6 has a blind bore (no numeral) into which a rear end of the shaft 2 is received. Within the bore of the front cover 5, there is installed a ball bearing 20 for bearing the front portion of the shaft 2, and within the bore of the rear cover 6, there is installed another bearing 21 for bearing the rear portion of the shaft 2.

Each pump unit 3A or 3B comprises a rotor 7 securely disposed on the rotation shaft 2 and having a plurality of radially extending grooves 8 (or vane mounting grooves), a plurality of vanes 9 slidably and projectably received in the grooves 8, a cam ring 10 accommodating the rotor 7, and a side plate 11 putting the cam ring 10 between it and the front cover 5 or rear cover 6. The rotor 7 is made from sintered metal, sintered alloy or the like.

Figure 3A:
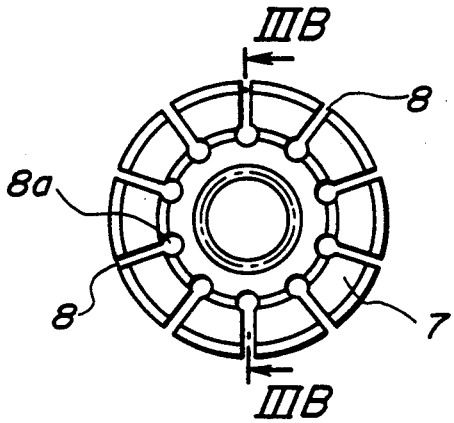
FIG. 3A is a plan view of a rotor used in the vane pump of the first embodiment.

As is seen from FIG. 3A, each vane mounting groove 8 of the rotor 7 has an enlarged bottom portion 8*a*.

Each of the front cover 5 and the rear cover 6 is formed with an inlet passage 12. One end of the inlet passage 12 is connected to an inlet pipe 13 which extends to a fluid storage tank (not shown). The other end of the inlet passage 12 is connected to two inlet ports 14*a* and 14*b* (see FIG. 2) of the pump 1.

Figure 2:
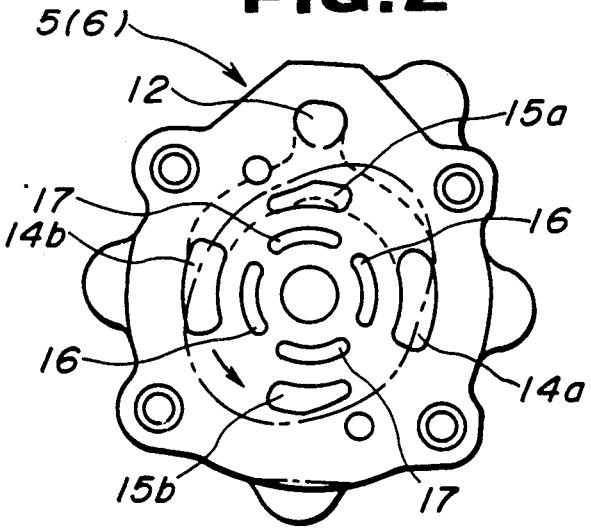
FIG. 2 is a sectional view taken along the line II—II of FIG. 1.

As will be understood from FIG. 2, each of the front cover 5 and the rear cover 6 is formed with two outlet ports 15*a* and 15*b* and two pairs of back pressure grooves 16 and 17. These back pressure grooves 16 and 17 function to introduce the hydraulic fluid to the bottom portions 8*a* of the grooves 8 of the rotor 7. More specifically, the back pressure grooves 16 apply a hydraulic pressure to base end portion 9*a* (viz., the bottom portions 8*a* of the rotor grooves 8 in which the corresponding vanes 9 are received) of the vanes 9 when these vanes 9 travel in a suction zone of the pump 1.

As is seen from FIG. 2, each pair of the back pressure grooves 16 and 17 are arranged at diametrically opposed positions with respect to the rotation center of the rotor 7 in such a manner as to deal with the charging and discharging strokes of the pump 1. The back pressure grooves 16 are connected to an after-mentioned fluid discharge chamber 22 (see FIG. 2).

In the present invention, the following measure is employed.

Figure 3B:
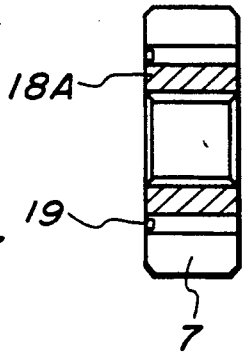
FIG. 3B is a sectional view taken along the line III-B—IIIB of FIG. 3A.

That is, as is seen from FIGS. 3A and 3B, the rotor 7 is formed at its one side 18A with an annular throttle groove 19 to which the enlarged bottom portions 8*a* of the vane mounting grooves 8 are exposed.

Figure 4:
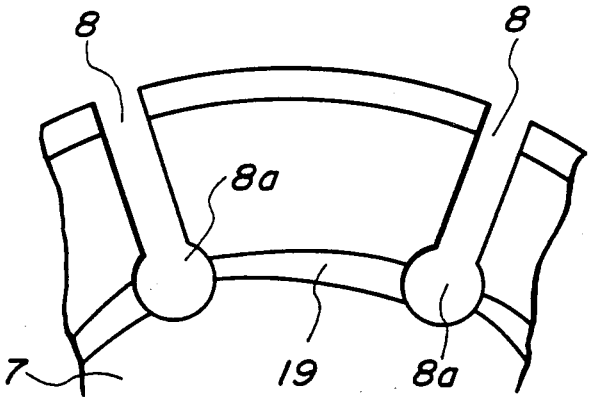
FIG. 4 is an enlarged view of a part of the rotor, showing the detail of an annular throttle groove formed on the rotor.

The detail of the throttle groove 19 is shown in FIG. 4. That is, the groove 19 comprises a plurality of throttled groove portions each connecting the neighboring bottom portions 8*a* of the vane mounting grooves 8. Each throttled groove portion tapers from an enlarged end toward a throttled end, as shown. According to this configuration, the flow of the hydraulic fluid from the back pressure groove 16 toward the other back pressure groove 17 is fairly restricted, but the opposite flow from the groove 17 toward the groove 16 is smoothly carried out.

Preferably, the annular throttle groove 19 is provided by a mold die at the time when the rotor 7 is sintered. However, if desired, the throttle groove 19 may be provided by machining the rotor 7.

As has been described hereinabove, the front portion of the rotation shaft 2 is rotatably held by the ball bearing 20 installed in the front cover 5, and the rear portion of the shaft 2 is held by the other bearing 21. The rotation shaft 2 is driven by a known power source through a pulley 50 mounted to the front end of the shaft 2.

Referring back to FIG. 1, designated by numeral 22 are the fluid discharge chambers, each being connected to the above-mentioned outlet ports 15*a* and 15*b* of the front or rear cover 5 or 6. Designated by numeral 23 are flow control valves, each controlling the fluid discharge from the corresponding fluid discharge chamber 22.

In the following, operation of the vane pump 1 will be described with reference to the drawings. For ease, the description will be made with respect to only the front pump unit 3A (see FIG. 1). In fact, the rear pump unit 3B operates in substantially the same manner as the front pump unit 3A except for the direction in which the rotor rotates.

When the rotation shaft 2 is driven, the rotor 7 is rotated in, for example, a counterclockwise direction in FIG. 2, that is, in the direction of the arrow. With this, the vanes 9 on the rotor 7 are forced to travel in the cam ring 10 sliding their head portions along the inner surface of the cam ring 10. During this, each pump chamber P defined by neighboring two vanes 9 is subjected to expansion, contraction, expansion and contraction in order each rotation of the shaft 2. That is, when the pump chamber P is brought into the first expansion state, the hydraulic fluid is fed into the chamber P from the inlet passage 12 through the first inlet port 14*a* and when thereafter the pump chamber P is brought into the first contraction state, the hydraulic fluid in the chamber P is compressed and discharged into the fluid discharge chamber 22 through the first outlet port 15*a*. When then the pump chamber P is brought into the second expansion state, the hydraulic fluid is fed into the chamber P from the inlet passage 12 through the second inlet port 14*b*, and when thereafter the chamber P is brought into the second contraction state, the hydraulic fluid in the chamber P is compressed and discharged into the fluid discharge chamber 22 through the second outlet port 15*b*. Thus, each pump chamber P undergoes two suction states and two discharge states each rotation of the rotor 7.

The compressed fluid in the fluid discharge chamber 22 is led through the flow control valve 23 to a suitable hydraulic device, such as, a power steering device and the like.

During rotation of the rotor 7, the hydraulic fluid is led into the vane mounting grooves 8 through the back pressure grooves 16 and 17, and the annular throttle groove 19 of the rotor 7 controls the fluid communication between the vane mounting grooves 8 (namely, the fluid communication between the back pressure grooves 16 and 17). With this, the hydraulic pressure applied to the base end portions 9*a* of the vanes 9 is controlled thereby to appropriately control the force with which the heads of the vanes 9 contact to the oval inner surface of the cam ring 10.

Figure 5A:
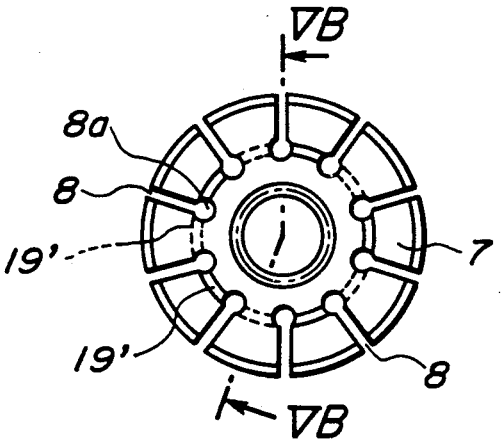
FIG. 5A is a plan view of a rotor used in a vane pump of a second embodiment of the invention.
Figure 5B:
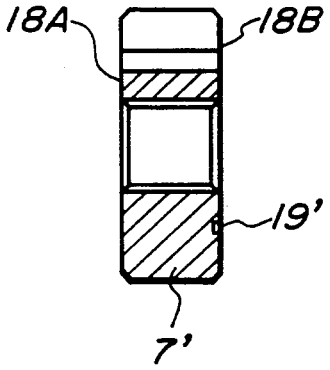
FIG. 5B is a sectional view taken along the line VB—VB of FIG. 5A.

Referring to FIGS. 5A and 5B, there is shown a rotor 7' used in a vane pump of a second embodiment of the present invention.

As will be understood from these drawings, the throttle groove 19' in this embodiment comprises a plurality of throttled groove portions which are alternatively formed on both sides 18A and 18B of the rotor 7'. That is, each groove portion is connected to its neighboring groove portion through the enlarged bottom portion 8*a* of the vane mounting groove 8 which extends therebetween. Thus, the throttle groove 19' extends circularly about the center of the rotor 7' but in a zigzag manner.

Figure 6A:
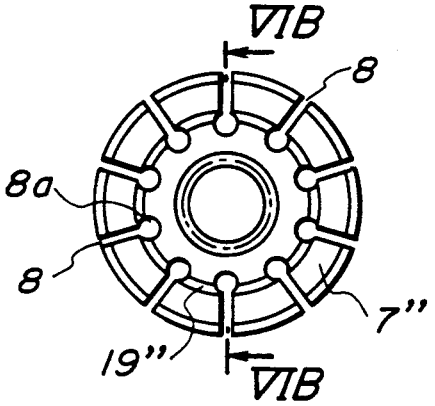
FIG. 6A is a plan view of a rotor used in a vane pump of a third embodiment of the invention.
Figure 6B:
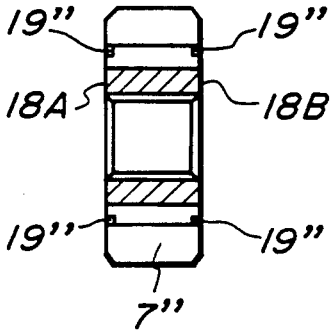
FIG. 6B is a sectional view taken along the line VIB—VIB of FIG. 6A.
Figure 7:
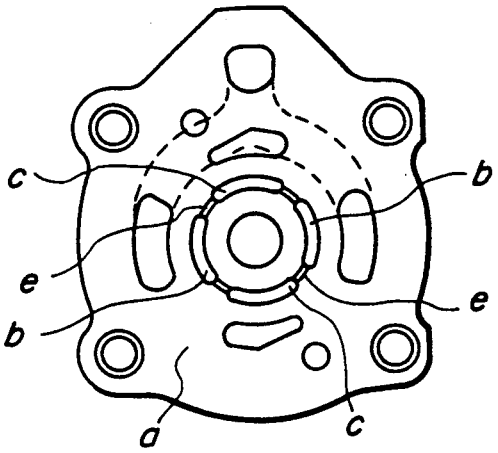
FIG. 7 (PRIOR ART)
FIG. 7 is a view similar to FIG. 2, but showing a rear cover of a conventional vane pump.

Referring to FIGS. 6A and 6B, there is shown a rotor 7'' used in a vane pump of a third embodiment of the present invention.

As will be understood from these drawings, in this embodiment, annular throttle grooves 19'' are respectively formed on both sides 18A and 18B of the rotor 7''. Each groove 19'' is positioned at a somewhat radially outer side of the enlarged bottom portions 8*a* of the vane mounting grooves 8. This measure enables the rotor 7'' to be produced without sacrificing the mechanical strength of the same.

In the following, advantages of the present invention will be described.

First, since the annular throttle groove 19, 19' or 19'' is provided by the rotor 7, 7' or 7'' whose hardness is higher than that of the front cover 5, the rear cover 6 and the side plate 11, the undesired deformation of the throttle groove 19, 19' or 19'' is suppressed or at least minimized even after long use of the pump 1. This provides the pump 1 with a longer life.

Second, because the rotor 7, 7' or 7'' is constructed of a sintered metal or the like, the annular throttle groove 19, 19' or 10'' can be provided by a mold die used at the time when the rotor 7, 7' or 7'' is sintered. This means that the annular throttle groove 19, 19' or 19'' can be produced easily as compared with the afore-mentioned conventional vane pump.

Third, because of usage of the mold die for providing the rotor 7', 7' or 7'' with the throttle groove 19, 19' or 19'', such a complicated annular throttle groove 19 as shown in FIG. 4 can be readily produced. When such complicated throttle groove 19 is practically used, undesired flow of compressed hydraulic fluid toward a vane mounting groove 8 under discharge state of the corresponding vane 9 is suppressed or at least minimized. Thus, the heads of the vanes 9 are prevented from being abnormally worn. Thus, the tracing ability of the vane heads against the cam ring is kept appropriately for a long period.

While only three embodiments according to the present invention have been shown and described hereinabove, it is understood that the invention is not limited thereto but is susceptible of numerous changes and modifications.

What is claimed is:

1. A vane pump, comprising:

body means defining a space which has mutually opposed surfaces;

a cam ring tightly disposed in said space;

a rotor having a plurality of radially extending vane mounting grooves, said rotor being rotatably disposed in said cam ring having both sides thereof slidably contacting with said opposed surfaces of the body means, said rotor being constructed of a material whose hardness is higher than that of said body means; and a plurality of vanes slidably disposed in said vane mounting grooves in such a manner that heads of the vanes slidably contact with an inner surface of said cam ring, wherein said rotor is formed at at least one side thereof with a throttle groove to which bottom portions of said vane mounting grooves are exposed, and wherein said throttle groove includes a plurality of throttled groove portions each connecting bottom portions of neighboring vane mounting grooves, each throttled groove portion tapering from an enlarged end to a smaller end.

2. A vane pump as claimed in claim 1, in which said rotor is constructed of a sintered metal or sintered alloy.

3. A vane pump as claimed in claim 1, in which said throttle groove is an annular groove which is concentric with said rotor.

4. A vane pump as claimed in claim 1, in which said rotor is further formed at the other side thereof with another throttle groove to which the bottom portions of said vane mounting grooves are exposed.

5. A vane pump as claimed in claim 1, in which said throttled groove portions are alternately formed on both sides of said rotor, each throttled groove portion on one side of said rotor being connected to its neighboring groove portion on the other side of said rotor through a bottom portion of one vane mounting groove, so that the throttle groove extends circularly around a center of said rotor.

6. A vane pump as claimed in claim 3, in which said annular throttle groove is positioned at a radially outer side of the bottom portions of the vane mounting grooves.

7. A vane pump as claimed in claim 4, in which each of the two throttle grooves is an annular groove which is concentric with said rotor and positioned at a radially outer side of the bottom portions of the vane mounting grooves.

8. A vane pump as claimed in claim 1, in which the bottom portion of each vane mounting groove is enlarged as compared with the remaining portion.

9. A vane pump, comprising:

a body having a recess;

a side plate tightly installed in said recess;

a cover secured to said body to cover said recess thereby to define an enclosed space between an outer surface of said side plate and an inner surface of said cover, said cover being formed at the inner surface thereof with inlet and outlet ports and back pressure grooves;

a cam ring tightly disposed in said enclosed space;

a rotor having a plurality of radially extending vane mounting grooves, said rotor being rotatably disposed in said cam ring having both sides thereof slidably contacting with said outer surface of the side plate and said inner surface of said cover, said rotor being constructed of a material whose hardness is higher than that of said body; and a rotation shaft passing through said body, said side plate and said cover, said rotation shaft having a middle portion on which said rotor is securedly disposed; and a plurality of vanes slidably disposed in said vane mounting grooves in such a manner that heads of said vanes slidably contact with an inner surface of said cam ring, wherein said rotor is formed at at least one side thereof with a throttle groove to which bottom portions of said vane mounting grooves are exposed, and wherein said throttle groove includes a plurality of throttled groove portions each connecting bottom portions of neighboring vane mounting grooves, each throttled groove portion tapering from an enlarged end to a smaller end.

10. A vane pump as claimed in claim 9, in which said rotor is constructed of a sintered metal or sintered alloy.

11. A vane pump as claimed in claim 9, in which said throttle groove is an annular groove which is concentric with said rotor.

12. A vane pump as claimed in claim 9, in which said rotor is further formed with at the other side with another throttle groove to which the bottom portions of said vane mounting grooves are exposed.

13. A vane pump as claimed in claim 9, in which said throttled groove portions are alternately formed on both sides of said rotor, each throttled groove portion on one side of said rotor being connected to its neighboring groove portion on the other side of said rotor through a bottom portion of one vane mounting groove, so that the throttle groove extends circularly around a center of said rotor.

14. A vane pump as claimed in claim 9, in which said annular throttle groove is positioned at a radially outer side of the bottom portions of the vane mounting grooves.

15. A vane pump as claimed in claim 12, in which each of the two throttle grooves in an annular groove which is concentric with said rotor and positioned at a radially outer side of the bottom portions of the vane mounting grooves.

16. A vane pump as claimed in claim 9, in which the bottom portion of each vane mounting groove is enlarged as compared with the remaining portion.

17. A vane pump as claimed in claim 9, in which said said plate is formed at the outer surface thereof with back pressure grooves.

18. A vane pump, comprising:

a housing;

a rotation shaft passing through said housing; and two pump units mounted in said housing and coaxially arranged on said rotation shaft, each pump unit including body means defining in said housing a space which has mutually opposed surfaces; a cam ring tightly disposed in said space; a rotor securedly mounted on said rotation shaft and having a plurality of radially extending vane mounting grooves, said rotor being rotatably disposed in said cam ring having both sides thereof slidably contacting with said opposed surfaces, said rotor being constructed of a material whose hardness is higher than that of said body means; and a plurality of vanes slidably disposed in said vane mounting grooves in such a manner that heads of the vanes slidably contact with an inner surface of said cam ring, wherein said rotor is formed at at least one side thereof with a throttle groove to which bottom portions of said vane mounting grooves are exposed, and wherein said throttle groove includes a plurality of throttled groove portions, each connecting bottom portions of neighboring vane mounting grooves, each throttled groove portion tapering from an enlarged end to a smaller end.

19. A vane pump, comprising:

body means defining a space which has mutually opposed surfaces;

a cam ring tightly disposed in said space;

a rotor having a plurality of radially extending vane mounting grooves, said rotor being rotatably disposed in said cam ring having both sides thereof slidably contacting with said opposed surfaces of the body means;

a plurality of vanes slidably disposed in said vane mounting grooves in such a manner that heads of the vanes slidably contact with an inner surface of said cam ring, wherein said rotor is formed at at least one side thereof with a throttle groove to which bottom portions of said vane mounting grooves are exposed and wherein said throttle groove includes a plurality of throttled groove portions each connecting bottom portions of neighboring vane mounting grooves, each throttled groove portion tapering from an enlarged end to a smaller end.

* * * * *